US010475429B2

(12) United States Patent
Iori et al.

(10) Patent No.: US 10,475,429 B2
(45) Date of Patent: Nov. 12, 2019

(54) SOUND ACQUISITION DEVICE, PARTICULARLY FOR ACOUSTIC GUITARS

(71) Applicant: IK MULTIMEDIA PRODUCTION SRL, Modena (IT)

(72) Inventors: Enrico Iori, David (PA); Davide Barbi, Carpi (IT)

(73) Assignee: IK MULTIMEDIA PRODUCTION SRL, Modena (IT)

( * ) Notice: Subject to any disclaimer, the term of this patent is extended or adjusted under 35 U.S.C. 154(b) by 0 days.

(21) Appl. No.: 15/266,086

(22) Filed: Sep. 15, 2016

(65) Prior Publication Data

US 2017/0076705 A1 Mar. 16, 2017

(30) Foreign Application Priority Data

Sep. 15, 2015 (IT) ..... 102015000051454

(51) Int. Cl.

| | |
|---|---|
| ***G10H 3/12*** | (2006.01) |
| ***H04R 1/46*** | (2006.01) |
| ***H04R 3/04*** | (2006.01) |
| ***G10H 1/12*** | (2006.01) |
| ***G10H 3/18*** | (2006.01) |

(52) U.S. Cl.

CPC ..... *G10H 3/12* (2013.01); *G10H 1/12* (2013.01); *G10H 3/18* (2013.01); *G10H 3/186* (2013.01); *G10H 3/187* (2013.01); *G10H 3/188* (2013.01); *H04R 1/46* (2013.01); *H04R 3/04* (2013.01)

(58) Field of Classification Search

CPC ..... G10H 3/12; G10H 3/186; G10H 3/187; G10H 3/188; G10H 1/18; G10H 2240/285; H04R 1/46; H04R 3/04

See application file for complete search history.

(56) References Cited

U.S. PATENT DOCUMENTS

| | | | | |
|---|---|---|---|---|
| 3,869,952 A | | 3/1975 | Rowe | |
| 4,061,934 A | | 12/1977 | Rowe | |
| 5,422,955 A | * | 6/1995 | Guzman | G10D 3/00 381/118 |
| 7,015,390 B1 | | 3/2006 | Rogers | |

(Continued)

FOREIGN PATENT DOCUMENTS

| | | | |
|---|---|---|---|
| GB | 2486193 A | | 6/2012 |
| JP | 2015073272 A | * | 4/2015 |

OTHER PUBLICATIONS

Italian Search Report dated Apr. 25, 2016 received from Italian Patent Application No. UB20153633.

(Continued)

*Primary Examiner* — Davetta W Goins
*Assistant Examiner* — Kuassi A Ganmavo
(74) *Attorney, Agent, or Firm* — Scully, Scott, Murphy & Presser, P.C.

(57) ABSTRACT

A sound acquisition device, particularly for acoustic guitars, comprising sound acquisition elements connected to output and power supply elements. The sound acquisition elements comprise at least one microphone and are associated with a clip-like body adapted to be coupled along the edge of the sound hole of a soundbox of an acoustic musical string instrument, the clip-like body being configured to support the sound acquisition elements inside the soundbox.

8 Claims, 5 Drawing Sheets

(56) References Cited

U.S. PATENT DOCUMENTS

| | | | | |
|---|---|---|---|---|
| 8,129,608 | B2 * | 3/2012 | Lee | G10H 1/0058 84/267 |
| 2003/0131721 | A1 * | 7/2003 | Minakuchi | G10H 1/32 84/726 |
| 2005/0252363 | A1 * | 11/2005 | Rockett | G10H 1/348 84/723 |
| 2007/0144329 | A1 * | 6/2007 | Hollander | H04R 1/08 84/290 |
| 2007/0227341 | A1 * | 10/2007 | Iori | G10H 3/188 84/645 |
| 2008/0229905 | A1 | 9/2008 | Lau et al. | |
| 2011/0023691 | A1 * | 2/2011 | Iwase | G10H 1/0066 84/612 |
| 2011/0211713 | A1 * | 9/2011 | Cavallo-Romano | G10H 3/183 381/118 |
| 2013/0145922 | A1 * | 6/2013 | Shinoda | G10H 1/125 84/604 |
| 2014/0112483 | A1 * | 4/2014 | Etter | H03G 3/3005 381/56 |
| 2014/0224099 | A1 | 8/2014 | Webman | |
| 2015/0013526 | A1 * | 1/2015 | Packouz | G10H 3/186 84/603 |
| 2015/0059561 | A1 * | 3/2015 | Mejia | G10H 1/02 84/737 |

OTHER PUBLICATIONS

European Communication dated Jun. 14, 2019 received in European Application No. 16 188 933.2.

* cited by examiner

SOUND ACQUISITION DEVICE, PARTICULARLY FOR ACOUSTIC GUITARS

The present invention relates to a sound acquisition device, particularly but not exclusively useful and practical in the field of the acquisition of sound emitted by acoustic guitars with nylon or metal strings, with particular effectiveness in application in cases in which sound acquisition is intended for the recording and/or amplification of said sound.

When one wishes to acquire the sound emitted by any acoustic musical instrument, where the term is understood to reference a nonelectric to instrument such as can be for example an acoustic guitar, one of the most important aspects, if not the most important, is the quality of the acquisition, i.e., the level of match between the sound actually produced by the acoustic musical instrument and the information contained in the electrical signal, be it of an analog or digital type, generated by the devices used to perform the is acquisition.

The optimum solution for any musician or music producer is to perform a very high quality, or so-called "studio quality", acquisition, so that the electrical signal generated by the device used for the acquisition substantially totally matches the sound actually produced by the acoustic musical instrument.

Various types of device used for the acquisition of the sound emitted by acoustic guitars with nylon and metal strings are currently known.

Among these known devices, the currently most widespread solution. for achieving high acquisition quality is to use a condenser microphone that is fixed on a stand, said microphone being directed toward the soundbox of the acoustic guitar played by the musician and at a certain distance from it, typically between 20 and 30 centimeters.

It is in fact noted that the sound vibrations produced by the strings of the acoustic guitar develop within the soundbox by utilizing the physical phenomenon of resonance.

However, this known solution is not free from drawbacks, which include the fact that acquisition quality depends greatly on the placement and distance between the acoustic guitar and the microphone, so that variations of the relative position between the microphone and the soundbox of the guitar introduce variations in the strength and quality of the signal as received by the microphone. This in practice prevents the musician from moving or shifting while playing, since a movement or displacement on his part would lead to a variation in the position and distance between the acoustic guitar and the microphone, with consequent degradation of sound acquisition quality.

In order to obviate this drawback, which makes playing extremely inconvenient for the musician, further devices, such as piezoelectric pickups and microphones of various kinds, have been presented over time.

Piezoelectric pickups, currently used mostly in live playing, are predominantly of the so-called "under-bridge" type, i.e., piezoelectric pickups that are fitted under the bridge of the acoustic guitar. The pickups can be provided with a piezoelectric sell for each string of the acoustic musical string instrument and are capable of converting the vibrations of the strings into a signal of the electrical type.

However, even this known solution is not free from drawbacks, since although it allows the musician greater mobility than the above-cited microphone fixed on the stand, a pickup does not ensure the same quality of acquisition of the sound emitted by the acoustic guitar that can be obtained by means of a microphone. In particular, a considerable drawback relates to the fact that the analog electrical signal generated by means of a pickup has a timbre that is different from the timbre that would actually characterize the acoustic guitar.

As an alternative to piezoelectric pickups, small microphones are also available which are installed inside the soundbox of the acoustic musical string instrument. There are also so-called cartridge microphones, which are applied to the external surface of the soundbox by means of an adhesive, or also microphones which are fixed to the edge of the soundbox by means of a bracket and a small flexible rod.

One drawback of current internal microphones resides in that they must be necessarily installed in the soundbox during the manufacture of the acoustic musical string instrument or, if installed after manufacturing, require the intervention of a luthier. In addition to this, there is the problem related to the power supply of a microphone of this type, located in a position that is difficult to access for replacing batteries or for any maintenance intervention.

Furthermore, it is evident that these operations for installing internal microphones increase the cost of an acoustic guitar or more generally of a musical string instrument of the acoustic type and provided with a soundbox.

One technical drawback of these internal microphones further resides in that they can have the Larsen effect, also known as acoustic feedback, which alters the quality of the sound.

Moreover, it should also be noted that the noise signal is very high inside the soundbox of an acoustic guitar, making it difficult to acquire the sound actually produced by the acoustic musical instrument.

Cartridge microphones, instead, which detect sound vibration from the soundbox, independently of the position where they are fixed, have a double drawback. The first drawback resides in that since they must be fixed with chemical adhesives, they risk damaging irrevocably the acoustic guitar, in particular its soundbox. The second drawback instead relates to the quality of the acquired sound, since fixing to the surface of the soundbox allows to pick up only the sound waves that propagate out of said soundbox itself, with a loss of strength of the acoustic signal emitted inside the soundbox and with a loss of quality of said sound, the recording of which sounds slightly differently than the sound actually produced by the guitar.

Finally, with reference to microphones with a bracket and a flexible post, a first drawback arises from the increase in the space occupation of the acoustic guitar, making the movements of the musician awkward in any case while playing.

Moreover, it is noted that due to their very structure they do not allow correct orientation toward the soundbox, compromising the acquisition of the timbre that characterizes the acoustic guitar being played.

Like the above cited internal microphones, even these microphones with bracket and flexible post can have the Larsen effect or acoustic feedback.

Like piezoelectric pickups, therefore, although the types of microphone described above offer the musician greater mobility than the microphone fixed to the stand, these solutions in any case are not free from drawbacks. In particular, they do not ensure the same quality of acquisition. of the sound emitted by the acoustic guitar, with particular reference to the timbre that characterized the acoustic guitar being played.

In summary, the use of known piezoelectric pickups or of known small microphones does not ensure an acquisition of the sound emitted by the acoustic guitar, or more generally of the acoustic musical string instrument, with studio quality.

The aim of the present invention is to overcome the limitations of the background art cited above, providing a sound acquisition device, particularly for acoustic guitars, that allows to achieve effects that are similar to or better than those that can be obtained with the known solutions, allowing the musician to move freely while playing, without running the risk that this movement might influence negatively the quality of the acquisition of the sound emitted by the acoustic guitar being played.

Within this aim, an object of the present invention is to conceive a sound acquisition device, particularly for acoustic guitars, that allows to acquire the sound emitted by an acoustic guitar, with nylon or metal strings, with studio quality, in particular with the timbre that actually characterizes the acoustic guitar being played.

Another object of the present invention is to devise a sound acquisition device, particularly for acoustic guitars, that does not force the musician to locate and hold a point of acquisition or an optimum distance for the acquisition of the sound emitted by the acoustic guitar that he is playing.

A further object of the present invention is to conceive a sound acquisition device, particularly for acoustic guitars, the installation of which does not entail invasive operations that might damage the acoustic guitar, whether performed by a luthier or by the musician himself Another object of the present invention is to devise a sound acquisition device, particularly for acoustic guitars, that allows the optional processing and/or correction of the acquired sound, in particular of the is timbre that characterizes the acoustic guitar being played.

Another object of the present invention is to provide a sound acquisition device, particularly for acoustic guitars, that is highly reliable, relatively simple to provide and at modest costs.

This aim, as well as these and other objects that will become better apparent hereinafter, are achieved by a sound acquisition device, particularly for acoustic guitars, comprising sound acquisition means connected to output and power supply means, characterized in that said sound acquisition means comprise at least one microphone and are associated with a clip-like body adapted to be coupled along the edge of the sound hole of a soundbox of an acoustic musical string instrument, the clip-like body being configured to support said sound acquisition means inside said soundbox.

Further characteristics and advantages of the invention will become better apparent from the description of a preferred but not exclusive embodiment of the sound acquisition device, particularly for acoustic guitars, according to the invention, illustrated by way of nonlimiting example in the accompanying drawings, wherein.

FIGS. 5*a*, 5*b*, 5*c* and 5*d* show some possible screens of the graphical interface for interaction between a user and an embodiment of the sound acquisition device, particularly for acoustic guitars, according to the present invention.

Figure 6:
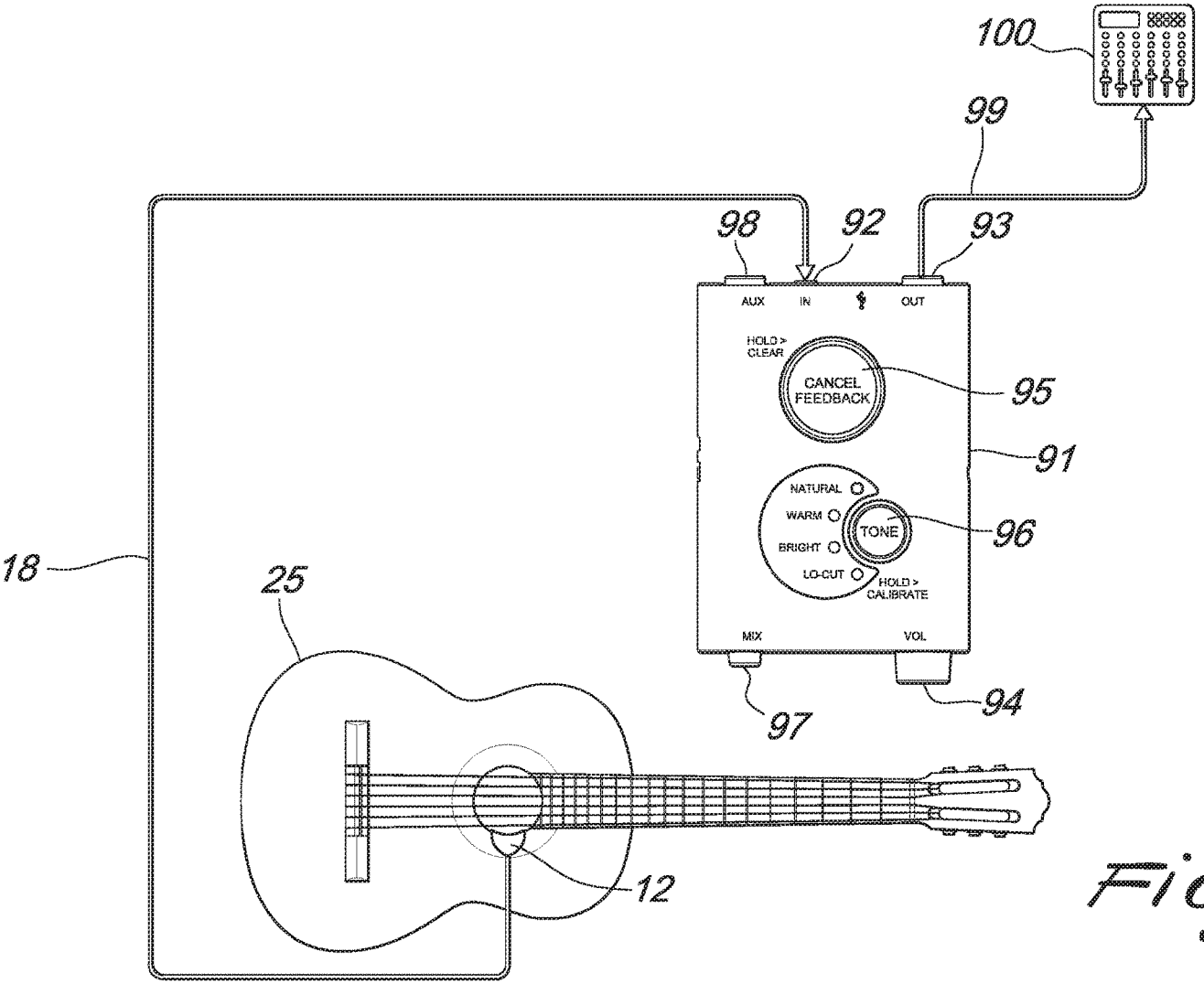

FIG. 6 is a general view of a second embodiment of the sound acquisition device, particularly for acoustic guitars, according to the present invention.

With reference to the cited figures, the sound acquisition device according to the invention, designated generally by the reference numeral 10, substantially comprises a clip-like body 12, sound acquisition means 14 and 16, output and power supply means 18, and inline electronic means 20.

The clip-like body 12 is adapted to be coupled or engaged along the edge of the sound hole 32 of a soundbox 30 of an acoustic guitar 25, or more generally of an acoustic musical string instrument.

This clip-like body 12 has reduced dimensions; in particular it is thin enough to not interfere with the strings 34 of the acoustic guitar 25, especially when they are vibrating, and not cause an encumbrance to the musician while he is playing.

In order to be coupled on the edge of the sound hole 32 of the acoustic guitar 25, the clip-like body 12 is provided with a slit or groove provided between its outer portion, i.e., the portion that will remain visible externally following coupling, and its internal portion, i.e., the portion that will remain hidden inside the soundbox 30 as a consequence of the coupling on the acoustic guitar 25.

The depth of the slit is variable from one embodiment to another, according to the requirements, and is determined substantially by the thickness, along the edge or proximate to the sound hole 32, of the soundbox 30 of the acoustic guitar 25 on which the device 10 must be coupled.

The output and power supply means 18, constituted for example by an electrical cable, are connected to the external portion of the clip-like body 12.

The output and power supply cable 18 is adapted to connect the sound acquisition device 10 according to the invention to an external electronic or electromechanical device or apparatus, such as can be for example a recorder, an amplifier, or a processing device of various types. This external. device or apparatus receives in input the analog or digital electrical signal that corresponds to the acquired sound and preferably comprises means adapted to supply power to said device 10.

In an embodiment that is alternative with respect to the one described above, the sound acquisition device 10 according to the invention can be provided with output and power supply means 18 which comprise a wireless communication module, for example of the Bluetooth type, and a power supply battery, as a replacement of the electrical cable.

The sound acquisition means 14 and 16, which are connected to said output and power supply cable 18, are arranged within the internal portion of the clip-like body 12.

In a preferred embodiment of the sound acquisition device 10 according to the invention, the sound acquisition means 14 and 16 constitute or comprise a miniaturized semiconductor microphone.

In one embodiment of the device 10 according to the invention, the sound acquisition means can comprise microcartridges 14, which are adapted to detect the sound vibrations that pass through adapted openings provided in the internal portion of the clip-like body 12, and transducer means 16, which are adapted to convert these sound vibrations into an electrical signal in an analog format to be transmitted in output by means of the output and power supply cable 18.

The sound acquisition means 14 and 16 are preferably arranged, on the device 10 according to the invention, so as to be within the soundbox 30 when the sound acquisition device 10 is coupled on the acoustic guitar 25.

In particular, the placement of the sound acquisition means proximate to the sound hole of the soundbox 25 of the musical instrument allows to acquire sound in the position in which the signal/noise ratio is highest within and in the vicinity of the instrument, and so is the strength of the signal itself.

In a preferred embodiment of the sound acquisition device 10 according to the invention, the sound acquisition means 14 and 16 are of the type characterized by an omnidirectional frequency response of the type that minimizes or cancels the proximity effect and bass enhancement.

In a preferred embodiment of the sound acquisition device 10 according to the invention, the clip-like body 12 is provided by using as material rubber or a mixture of plastic and rubber, so as to ensure optimum grip on the edge of the sound hole 32; furthermore, the clip-like body 12 is preferably co-molded with the output and power supply cable 18 with a tangle prevention purpose.

By way of example, the clip-like body 12 of the sound acquisition device 10 according to the invention can be provided in such a way as to couple to the edge of the sound hole 32 of a soundbox 30, the thickness of which can vary from 2 millimeters to 4 millimeters, thus adapting to the different thicknesses that the soundbox 30 can have, along the edge or proximate to the sound hole 32, in the various commercially available acoustic guitars 25, by virtue of the elasticity of the material of which it is made, which, as mentioned, is preferably rubber.

Also by way of example, the clip-like body 12 of the sound acquisition device 10 according to the invention can be provided so as to engage on the edge of a sound hole 32 the diameter of which can vary from 3 ¼ inches to ⅛th. of an inch, thus adapting again to the different diameters that the sound hole 32 can have in the various commercially available acoustic guitars 25.

In a preferred embodiment of the invention, the sound acquisition. device 10 can be provided with inline electronic means 20, for example installed along the output and power supply cable 18, which comprise a bank of filters, in practice an equalizer, which is configured to perform a frequency filtering action on the peaks of the acquired signal, so as to have a more natural timbre response which is substantially identical to that which one would obtain by using in a studio a microphone fixed on the stand.

Furthermore, these inline electronic means 20 can also comprise an analog-digital converter (ADC) adapted to perform the optional analog-digital conversion of the analog electrical signal that corresponds to the sound acquired by the sound acquisition means 14 and 16.

In one embodiment of the sound acquisition device 10 according to the invention, the output and power supply cable 18 can be connected to a processing device 90, preferably a mobile one, such as for example a smartphone or a tablet, which, in addition to receiving in input the electrical signal in digital format that corresponds to the acquired sound and to supplying power to said device 10, can advantageously be configured so as to allow the processing and/or correction of the acquired sound, in particular of the timbre that characterizes the acoustic guitar being played.

In practice, this configuration, performed for example by installing an appropriately provided app on the above cited mobile processing device 90, allows to process the acquired sound so as to obtain an optimized tonal response. Sound processing can be performed by means of known procedures and methods, which are given parameters by taking into account the characteristics of the sound acquisition means 14 and 16 and their position in the soundbox 30 on which the sound acquisition device 10 has been coupled.

By way of example, this appropriately configured mobile processing device 90 can be used to correct automatically the regions of the timbre that are excessively enhanced due to an incorrect or less than ideal placement of the device 10 according to the invention along the edge of the sound hole 32 of the acoustic guitar 25.

As an alternative, again by way of example, this mobile processing device 90, if appropriately configured, can be used to detect frequency peaks, which are then filtered automatically in order to have a more natural tonal response, which is substantially identical to the one that would occur by using in a studio a microphone fixed to the stand.

In order to process the acquired sound, the mobile processing device 90 must be further configured in relation to the specific acoustic guitar 25 the tonal response of which one wishes to optimize.

For example, in the case of the use of a mobile processing device 90 provided with the above cited app, the graphical interface for interaction between a user and the sound acquisition device 10 according to the invention, displayed by the app with which the mobile device 90 is provided, can comprise a series of screens adapted to guide the user in the procedure for configuring the device 10 in relation to the acoustic guitar 25 ("Setup Assistant").

A first screen. 40, which shows the user how to apply the device 10 to the edge of the sound hole 32 of the soundbox 30 of the acoustic guitar 25, can comprise, in the upper part, a brief text description 41 of the step shown ("Step—1: Place of the acquisition device on your guitar's sound hole"), in the central part, a video or an explanatory image 42 of the step shown and, in the lower part, two navigation buttons 45 and 47: the first button 45 ("Next") for proceeding to the next step of the configuration procedure and the second button 47 ("Cancel") to cancel and end in advance the procedure for configuration of the device 10.

A second screen 50, which shows the user how to connect the device 10 to the mobile device 90 by means of the output and power supply cable 18, can comprise, in the upper part, a brief text description 51 of the described step ("Step—2: Connect the acquisition device to your mobile device's input"), in the central part, a video or an explanatory image 52 of the illustrated step and, in the lower part, three navigation buttons 55, 56 and 57: the first button 55 ("Next") to continue to the next step of the configuration procedure, the second button 56 ("Back") to return to the preceding step of the configuration procedure, and the third button 57 ("Cancel") to cancel and terminate early the procedure for configuration of the device 10.

A third screen 60, which shows the user how to measure correctly the response of the acoustic guitar 25, can comprise, in the upper part, a brief text description 61 of the step shown ("Step—3: Learn Instrument Response; Follow the guidelines in the short video below to properly measure your instrument's response"), in the central part, a video 62 that explains the step shown and, in the lower part, three navigation buttons 65, 66 and 67: the first button 65 ("Learn") to start the measurement of the response of the acoustic guitar 25, the second button 66 ("Back") to go back to the preceding step of the configuration procedure, and the third button 67 ("Cancel") to cancel and terminate early the procedure for configuration of the device 10.

Finally, a fourth screen 70, which confirms to the user the correct ending of the configuration procedure of the device 10, can comprise, in the upper part, a brief text description 71 of the illustrated step ("Done! The acquisition device is perfectly optimized to match your acoustic guitar's response. Enjoy! Don't show again") and, in the lower part, three navigation buttons 75, 76 and 77: the first button 75 ("Close") to end with a positive outcome the configuration procedure that has just finished, the second button 56 ("Back") to return to the preceding step of the configuration procedure, and the third button 77 ("Cancel") to cancel the procedure for configuration of the device 10 that has just ended.

Figure 1:
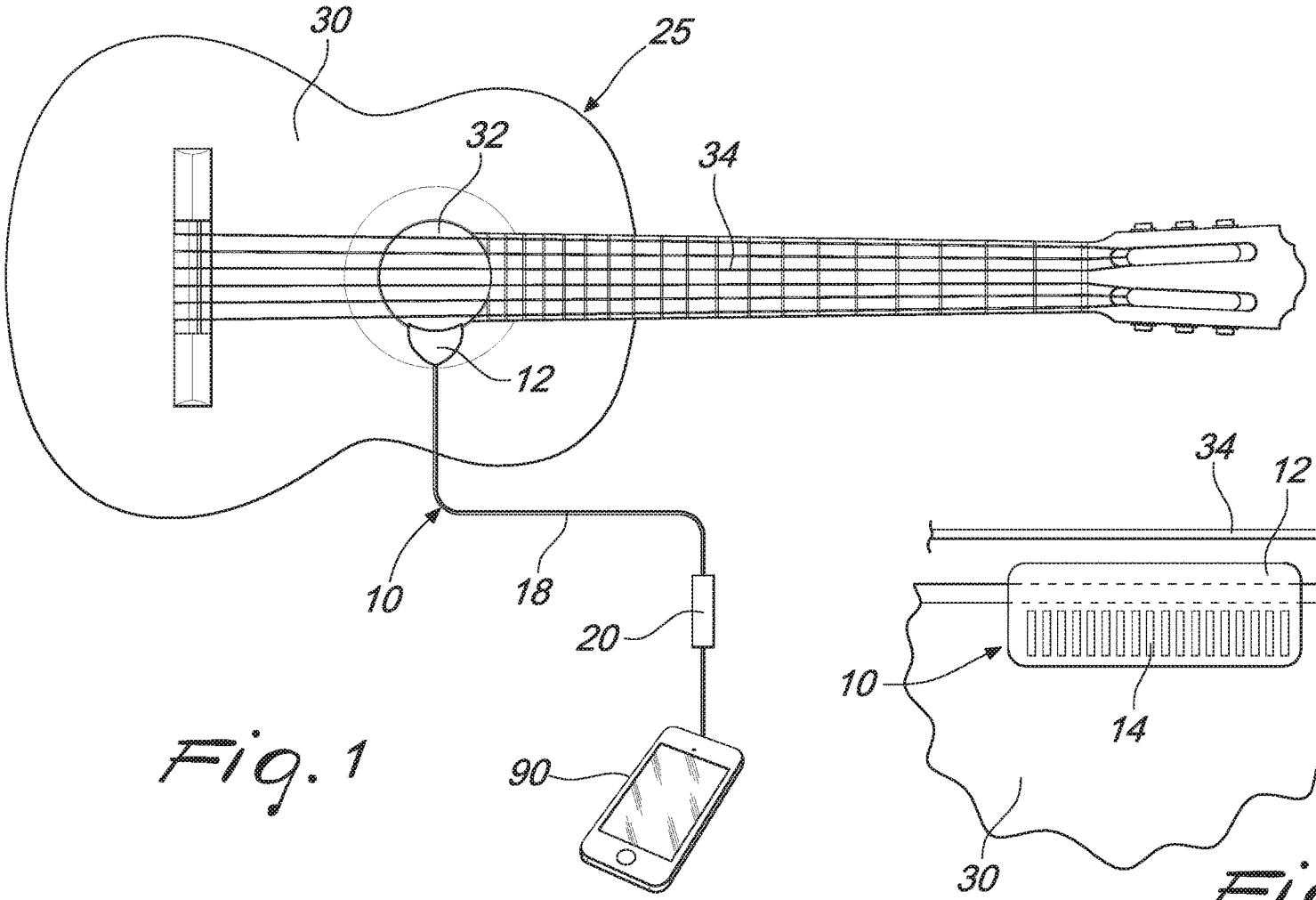
FIG. 1 is a general view of an embodiment of the sound acquisition device, particularly for acoustic guitars, according to the present invention.
Figure 2:
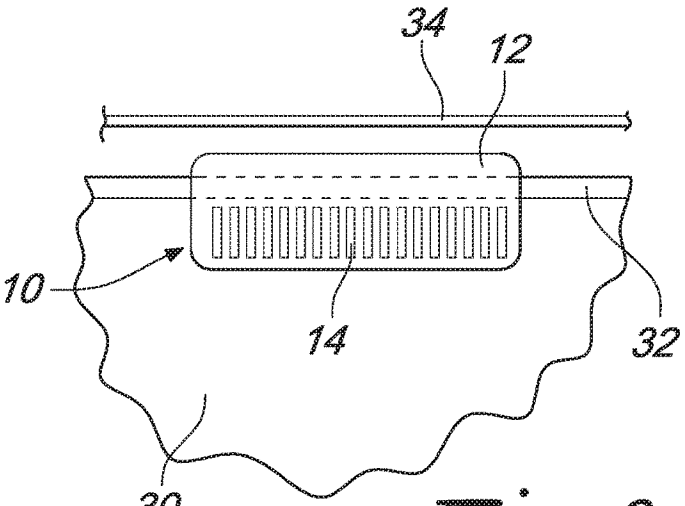
FIG. 2 is a top view of an embodiment of the sound acquisition device, particularly for acoustic guitars, according to the present invention.
Figure 3:
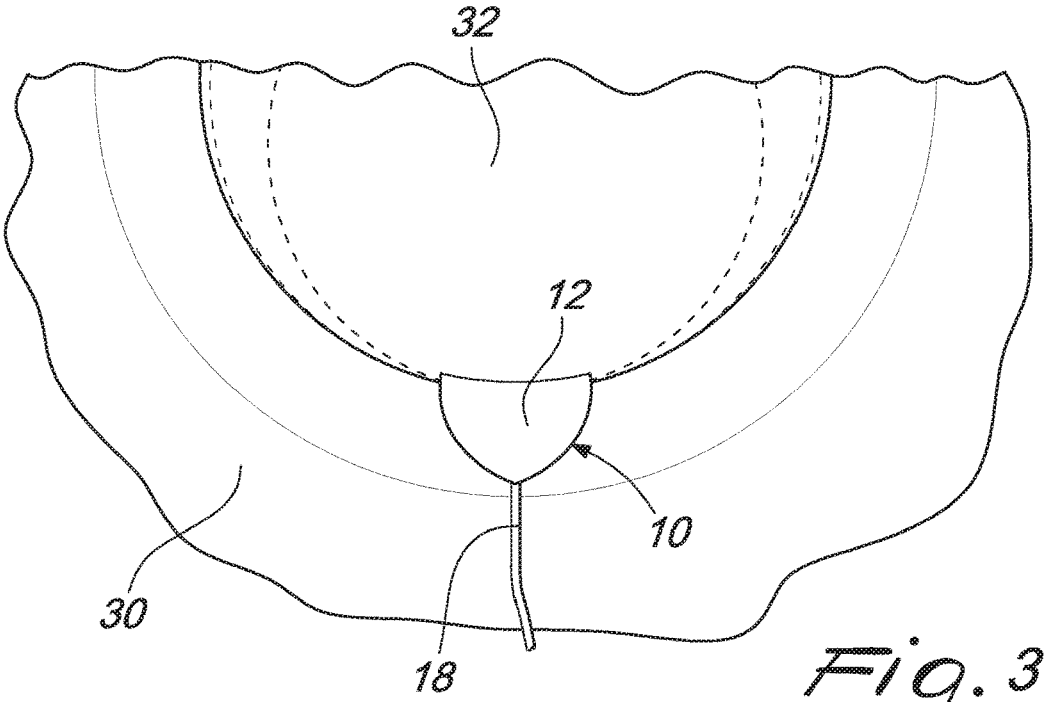
FIG. 3 is a front view of an embodiment of the sound acquisition. device, particularly for acoustic guitars, according to the present invention.
Figure 4:
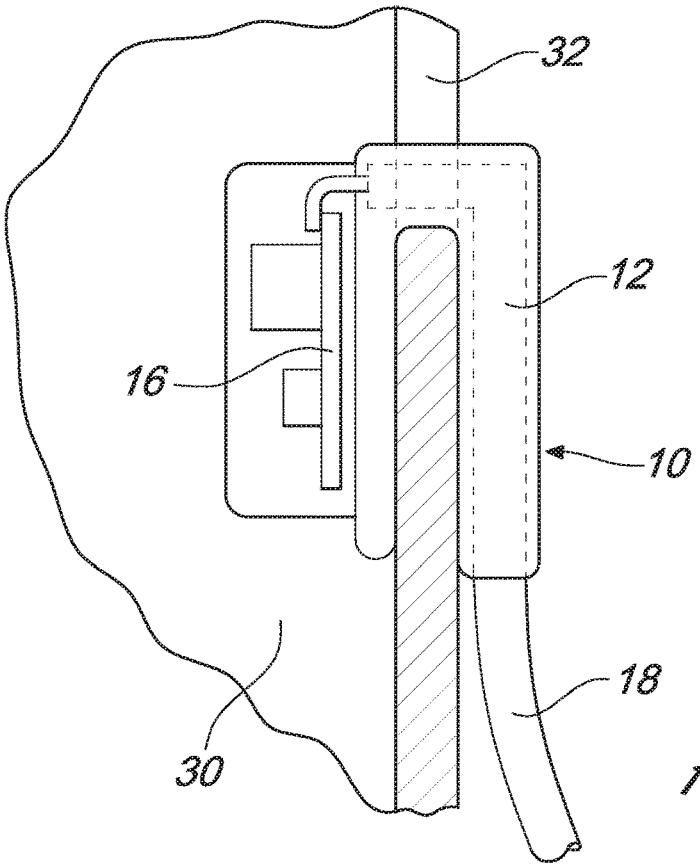
FIG. 4 is a sectional view of an embodiment of the sound acquisition device, particularly for acoustic guitars, according to the present invention.
Figure 5B:
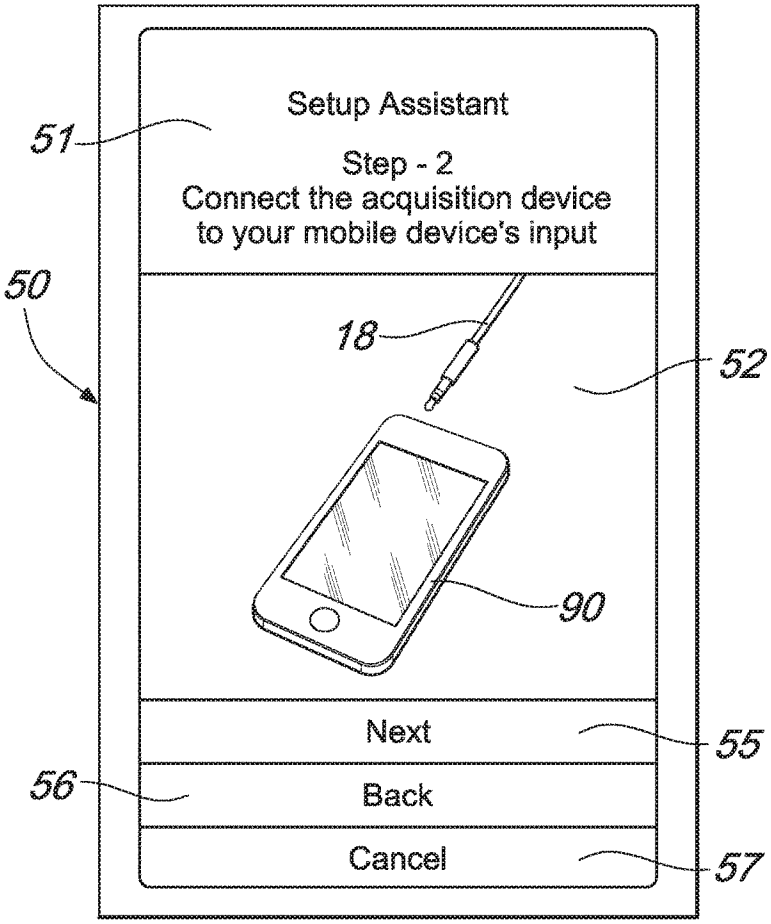
Figure 5A:
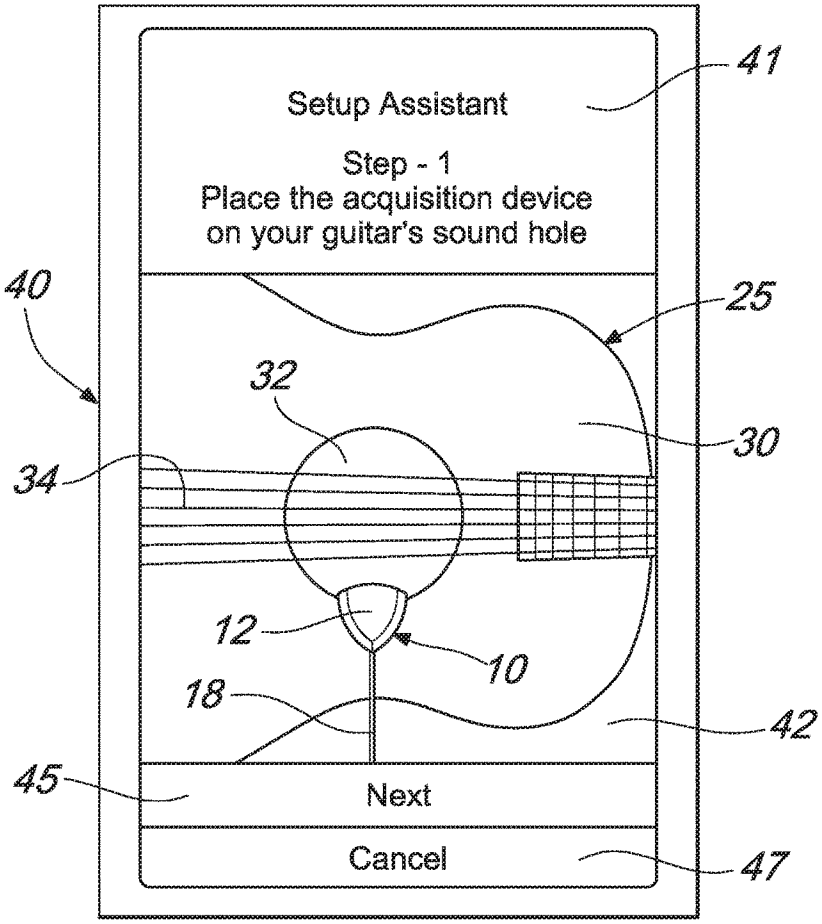
Figure 5D:
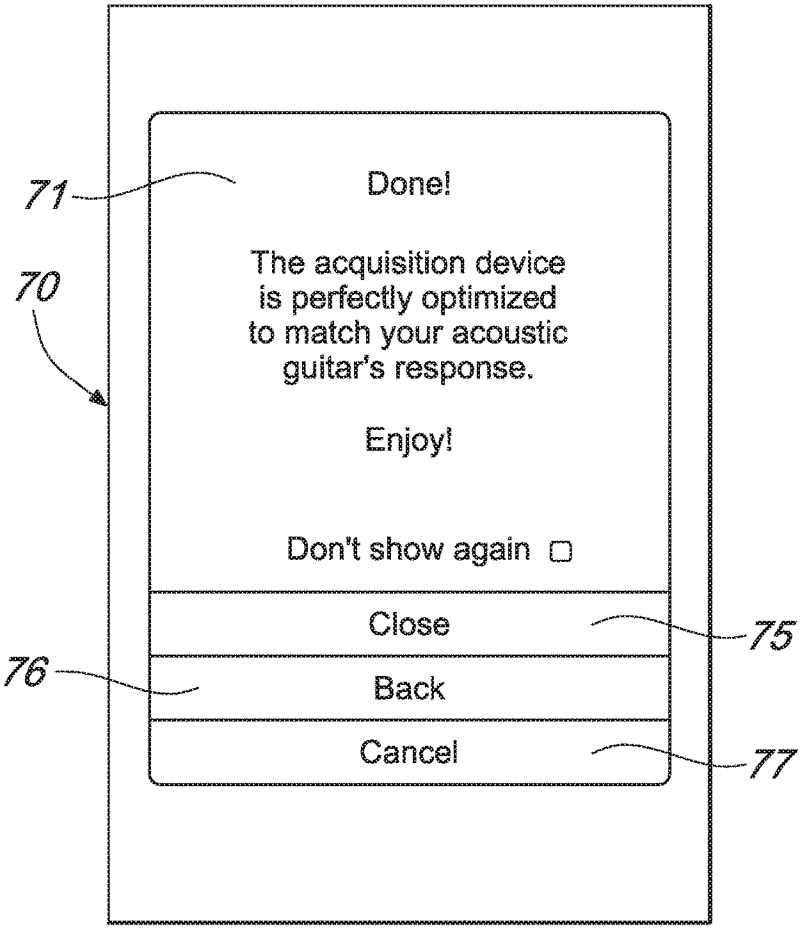
Figure 5C:
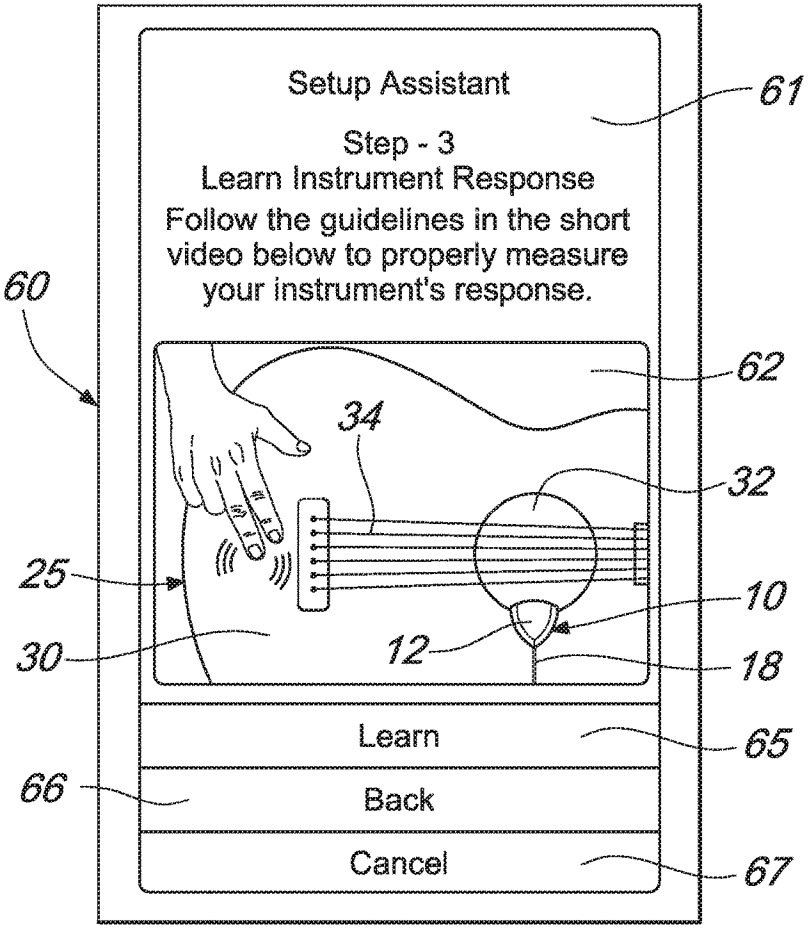

In one embodiment of the sound acquisition device 10 according to the invention, the processing device 90 may be in the form of a case that comprises a hardware and electronic implementation of at least part of the functionality previously described with reference to the embodiment of FIG. 1.

Cable 98 connects the sound acquisition means 14, 16 to processing device 91 through input port 92. Output port 93 may connect processing device 91 to an external device 100 for handling sound, for instance to a mixer, through output port 93 and connection cable 99. Volume knob 94 may control the volume of the sound signal transferred through the processing device.

A first user interface element 95, which may be in the form of a touch button or of a push button, may be activated to control the inline electronic means 20, already described, which in this embodiment may be embedded inside the case of the processing device.

A second user interface element 96, which may again be in the form of a touch button or of a push button, may be activated to provide functionality already described with reference to other embodiments, for instance to activate preset equalizer values and/or to change sound's tone. A button or a knob 97 may activate mixing of the input signal fed to the processing device through input port 92 with a further input signal fed into the device through a second input port 98. Second input port 98 may be a conventional AUX port.

In practice it has been found that the invention fully achieves the intended aim and objects. In particular, it has been shown that the sound acquisition device, particularly for acoustic guitars, thus conceived allows to overcome the qualitative limitations of the background art, since especially by virtue of the compact dimensions and the convenience in use it allows the musician to move freely while playing, without running the risk that this movement might influence negatively the quality of the acquisition of the sound emitted by the acoustic guitar being played.

Furthermore, the sound acquisition device according to the present invention allows to acquire the sound emitted by an acoustic guitar, with nylon or metal strings, with studio quality, in particular with reference to the timbre that actually characterizes the acoustic guitar being played, since the sound acquisition device is integral with the musical instrument and therefore is always in the same relative position at the time when a piece of music is played.

The sound acquisition device according to the invention allows for example to amplify acoustic guitars in so-called live and on stage situations, combining the greater mobility for the musician with an "acoustic" quality that conventional solutions, i.e. known piezoelectric pickups and microphones of various known types, are unable to offer.

Another advantage of the sound acquisition device according to the present invention resides in that it does not force the musician to find the optimum acquisition point/distance for acquisition of the sound emitted by the acoustic guitar being played.

Further advantages of the sound acquisition device according to the present invention reside in that its installation does not entail invasive operations that might damage the acoustic guitar and in that it allows the processing and/or correction of the acquired sound, in particular of the timbre that characterizes the acoustic guitar being played, for example by connection to an appropriately configured processing device.

Although the sound acquisition device according to the invention has been conceived in particular for the acquisition and/or recording of the sound emitted by acoustic guitars with nylon and metal strings, it can in any case be used more generally for the acquisition and/or recording of the sound emitted by any musical string instrument of the acoustic type and provided with a soundbox.

The invention thus conceived is susceptible of numerous modifications and variations, all of which are within the scope of the appended claims. All the details may further be replaced with other technically equivalent elements.

In practice, the materials used, as well as the contingent shapes and dimensions, may be any according to the requirements and the state of the art.

To conclude, the scope of the protection of the claims must not be limited by the illustrations or preferred embodiments shown in the description by way of example, but rather the claims must comprise all the characteristics of patentable novelty that reside in the present invention, including all the characteristics that would be treated as equivalents by the person skilled in the art.

The disclosures in Italian Patent Application No. 102015000051454 (UB2015A003633) from which this application claims priority are incorporated herein by reference.

What is claimed is:

1. A sound acquisition device, comprising sound acquisition means connected to output and power supply means, wherein:

said sound acquisition means comprise at least one microphone and are associated with a clip-like body adapted to be coupled along the edge of the sound hole of a soundbox of an acoustic musical string instrument, said clip-like body being configured to support said sound acquisition means inside said soundbox, said sound acquisition means comprise micro-cartridges adapted to detect sound vibrations and a transducer adapted to convert said sound vibrations into an analog electrical signal, said clip-like body comprises a slit between an outer portion of said clip-like body and an internal portion of said clip-like body, and said sound acquisition means are connected to a processing device configured to process acquired sound, so as to obtain an optimized tonal response, said processing device configured in relation to said acoustic musical string instrument by taking into account characteristics of said sound acquisition means and position of said sound acquisition means along the edge of the sound hole of the soundbox.

2. The sound acquisition device according to claim 1, wherein said sound acquisition means are of the type adapted to produce an omnidirectional frequency response with no proximity effect and with no bass enhancement.

3. The sound acquisition device according to claim 1, wherein said output and power supply means comprise an electrical cable.

4. The sound acquisition device according to claim 1, wherein said output and power supply means comprise a wireless communication module and a power supply battery.

5. The sound acquisition device according to claim 1, further comprising inline electronic means, which comprise an equalizer for filtering frequency peaks.

6. The sound acquisition device according to claim 5, wherein said inline electronic means comprise an analog-digital converter for converting said analog electrical signal.

7. The sound acquisition device according to claim 1, wherein said clip-like body is adapted to accommodate a portion of said soundbox proximate to said sound hole.

8. The sound acquisition device according to claim 1, wherein said processing device is configured to automatically correct regions of timbre that are excessively enhanced due to an incorrect position of said sound acquisition means along the edge of the sound hole of the soundbox.

* * * * *